United States Patent [19]

Barnel et al.

[11] Patent Number: 4,952,897

[45] Date of Patent: Aug. 28, 1990

[54] LIMITING CIRCUIT BREAKER

[75] Inventors: Pierre Barnel, Echirolles; François Lindeperg, Sassenage; Jean-Pierre Nebon, St. Martin-le-Vinoux; Philippe Perrier, Le Touvet, all of France

[73] Assignee: Merlin Gerin

[21] Appl. No.: 244,478

[22] Filed: Sep. 15, 1988

[30] Foreign Application Priority Data

Sep. 25, 1987 [FR] France ..... 87 13484

[51] Int. Cl.[5] ..... H01H 53/00

[52] U.S. Cl. ..... 335/147; 335/6

[58] Field of Search ..... 335/147, 6, 195, 16; 200/147 R, 151

[56] References Cited

U.S. PATENT DOCUMENTS 2,930,870 3/1960 Baer .
3,302,144 1/1967 Jensen .
4,631,508 12/1986 Cinquin et al. ..... 335/142

FOREIGN PATENT DOCUMENTS 683565 12/1966 Belgium .
2377086 7/1980 France .

*Primary Examiner*—E. A. Goldberg
*Assistant Examiner*—Lincoln Donovan
*Attorney, Agent, or Firm*—Arnold, White & Durkee

[57] ABSTRACT

The limiting circuit breaker comprises a Thomson effect propelling device for opening of the contacts.

The main contact bridge is securedly united to an operating rod surrounded by an annular opening coil of the propelling device. The latter comprises an opening disk which is movable in relation to the rod and an annular piston securedly united to the rod, springs being disposed between the disk and the piston, so as to return the disk to the rest position facing the coil at the end of the opening travel.

7 Claims, 5 Drawing Sheets

LIMITING CIRCUIT BREAKER

BACKGROUND OF THE INVENTION

The invention relates to a limiting circuit breaker with high-speed contact opening control by Thomson effect, comprising, per pole, a movable assembly having a movable main contact bridge forming a main circuit with a pair of stationary main contacts connected to current terminals, a movable arcing contact bridge forming with a pair of stationary arcing contacts an arcing circuit connected in parallel to the main circuit, a movable assembly operating mechanism, for opening the main circuit and the arcing circuit, comprising a Thomson effect propelling part, a locking device of the movable assembly in the open position of the contacts and an unlocking control device, the main contact bridge being disposed between the stationary main contacts and the Thomson effect propelling part, the movable assembly comprising an operating rod securedly united to the main contact bridge, the Thomson effect propelling part comprising an annular opening coil surrounding said rod and an opening disk disposed facing the opening coil.

A circuit breaker of this kind is known from U.S. Pat. No. 3,302,144.

A limiting circuit breaker is moreover known (French Patent No. 2,377,087) wherein the Thomson effect operating mechanism is disposed in the bottom part of the switchgear unit, on the opposite side from the breaking chambers, between the current input conductors folded into a bracket. In this second type of device, the operating rod, securedly united to the opening disk of the propelling part, passes between the stationary contacts and repels the movable contact bridge to move it away from the stationary contacts. In the circuit breaker of the first type considered, however, the operating rod driven by the opening disk exerts a traction force on the movable contact bridge.

The object of the invention is to perfect a circuit breaker of the first type considered, so as to make its operation more reliable while at the same time achieving a compact structure at a minimum cost.

SUMMARY OF THE INVENTION

According to the invention, the opening disk is movable in relation to said rod, the Thomson effect propelling part comprising an annular piston securedly united to the operating rod, springs being disposed between the disk and the piston, in such a way that a current supply to the opening coil causes repulsion of the disk and of the piston and movement of the operating rod to the open position of the contacts, said springs bringing the disk back to the rest position facing the coil at the end of the opening travel.

In a preferred embodiment, the circuit breaker comprises two breaking chambers disposed on either side of the arcing circuit, the circuit breaker case being formed by assembly of an intermediate case containing the breaking chambers and a contact assembly comprising the movable contacts and their drive parts, a bottom case from the rear face of which the current terminals protrude out, and a cover protecting the movable assembly control mechanism parts, located in the upper part of the case.

Servicing of the limiting circuit breaker is made easier by the provision of a contact sub-assembly, made of molded plastic material, comprising the movable contact bridges and able to be removed in a single block from the limiting circuit breaker after the bottom case constituting the base-plate of the unit has been removed.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

Figure 1:
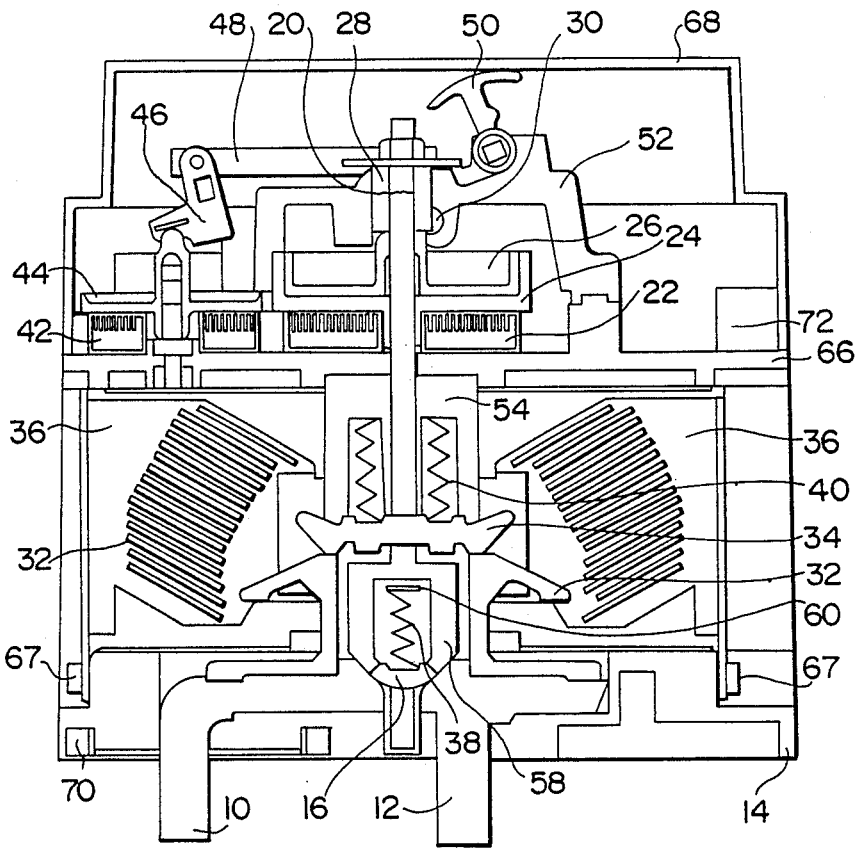
FIG. 1 is a sectional view of a pole of a limiting circuit breaker according to the invention, in the closed position of the contacts.
Figure 2:
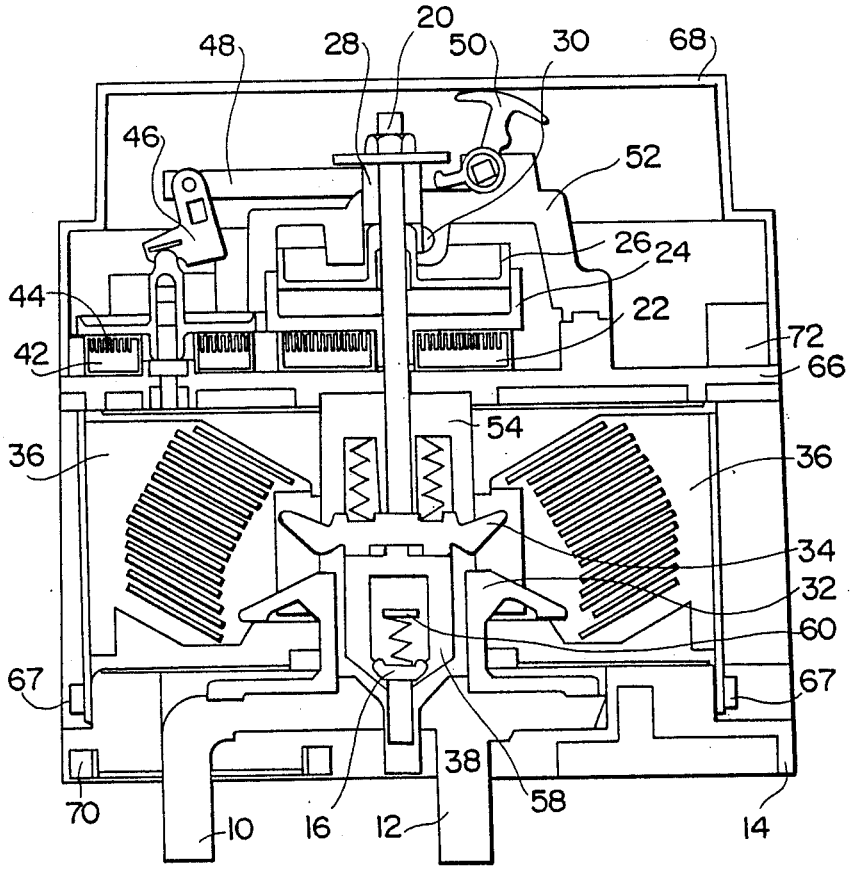
FIG. 2 is a view according to FIG. 1, in the open position of the contacts.

In FIGS. 1 and 2, a pole of a limiting circuit breaker comprises a pair of stationary main contacts connected to current terminals 10, 12 protruding out, on the rear face of the limiting circuit breaker, from a bottom case 14. The stationary main contacts cooperate with a main contact bridge 16, which may be formed by several parallel-mounted parts 17, belonging to a contact sub-assembly 18, represented in greater detail, in an exploded view, in FIG. 5, an operating rod 20 controlling opening of the contacts.

The operating rod 20 is biased to the open position, represented in FIG. 2, by a Thomson effect actuating device, located in the upper part of the circuit breaker and constltuted by an annular opening coil 22 facing which there is disposed an annular opening disk 24, of conducting material. In a state of the art manner, the supply of the opening coil by an electrical discharge, for example from a capacitor bank (not represented), results in induced currents being created in the opening disk, causing high-speed repulsion of the disk by Thomson effect.

According to the invention, the opening disk 24 is associated with an annular piston 26, made of conducting material, securedly united to the operating rod 20. The opening order causes the simultaneous upward movement of the opening disk 24, the piston 26 and the operating rod 20, thus causing the contacts to open. The top end of the operating rod is securedly united to a latching ring 28 which cooperates with a latching device, of the half-moon type 30, in such a way as to automatically ensure locking of the operating rod in the open position (FIG. 2). The latching ring 28 could possibly be replaced by a wider part forming an integral part of the operating rod. However the solution in two parts, represented in the figures, is preferred as it makes both maintenance and assembly easier.

At the end of the opening travel of the assembly formed by the opening disk, the piston and the operating rod, the rod and piston remain locked in the open position, whereas the opening disk 24, which is not securedly united to the operating rod, returns, to its initial position facing the opening coil 22, due to the action of springs, not shown, disposed between the disk and the piston.

Figure 5:
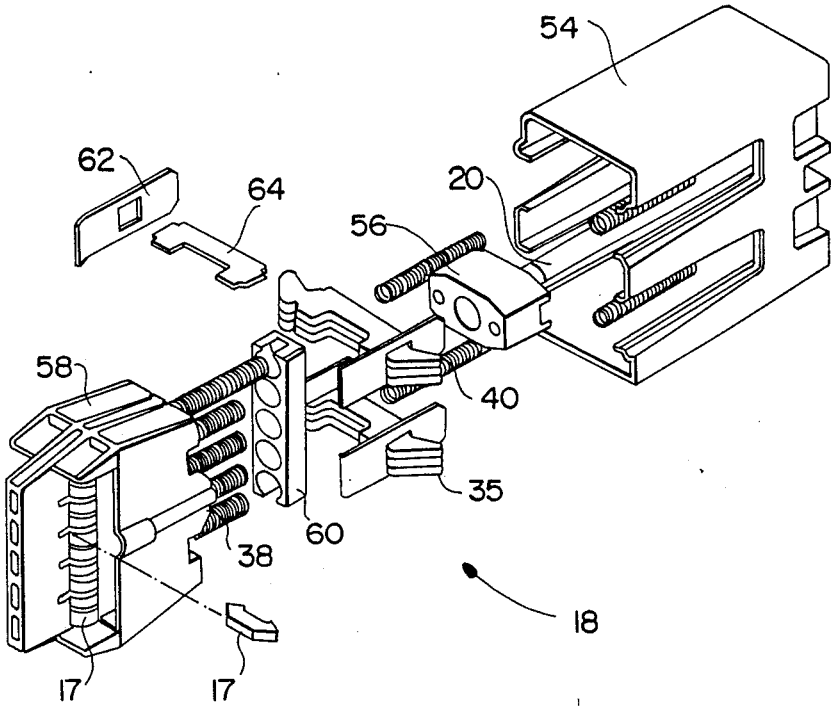
FIG. 5 is an exploded view of a contact sub-assembly of the limiting circuit breaker according to the invention.

An arcing circuit is connected in parallel to the terminals of the main circuit and comprises two stationary arcing contacts 32, connected to the terminals 10, 12 and whose upper ends are arranged as arcing horns, these stationary arcing contacts cooperating with a movable arcing contact bridge 34, possibly formed by several parallel-mounted parts (FIG. 5).

The contact sub-assembly 18 is arranged in such a way that the upward movement of the operating rod 20 first causes the main contact bridge 16 to move and the current to be switched to the arcing circuit, then causes the arcing circuit to open by the upward movement of the arcing contact bridge 34.

Two breaking chambers 36, of standard type, arranged on either side of the operating rod 20, perform extinction of the two arcs coupled in series when the arcing circuit opens.

In a preferred embodiment, represented in FIG. 5, the movable arcing contacts are formed by two sub-groups of movable arcing contact bridges 35, disposed on either side of the operating rod 20, in such a way as to obtain formation of two arcs in series in the plane in FIG. 1, these two arcs being in parallel on two other arcs, themselves in series in a plane parallel to the previous one. Four breaking chambers are then arranged so as to extinguish the four arcs.

The circuit breaker comprises an unlocking device enabling the contacts to return to the closed position by the action of return springs 38 and 40 acting respectively on the main contact bridge 16 and on the arcing contact bridge 34.

The unlocking device, designed to break the blocking of the latching ring 28 by the half-moon 30, preferably uses the Thomson effect. A closing coil 42, when it is supplied with an electrical discharge, for example by means of capacitors (not shown), causes high-speed repulsion of a closing disk 44 which is normally biased to the position near the coil by springs not represented in the figures. The upward movement of the closing disk 44 causes pivoting of a closing bar 46, bringing about movement of a closing rod 48. The latter acts on the half-moon 30 in such a way as to unlock the latching ring 28.

An indicating part 50 is mounted on a fixed bearing 52, so as to able to pivot due to the action of the torsion springs, from a closed position (FIG. 1), where one of the ends of the part is urged downwards by the operating rod 20, to an open position (FIG. 2). An electrical contact (not shown), disposed in such a way as to be actuated by the operating rod 20 at the same time as the indicating part 50, also enables electrical indication of the circuit breaker position to be achieved. As shown in the figures, the bearing 52 also acts as guiding part for the latching ring 28, the piston 26, the opening disk 24, and the half-moon 30.

The contact sub-assembly 18, represented in the exploded view in FIG. 5, forms a sub-assembly that is easily disassembled, which makes it easy to service or to replace. All the parts of this sub-assembly, except the contact bridges, the springs, and the rod 20, are made of molded plastic material. It comprises a contact box 54 in which the arcing contact bridge return springs 40 are housed. The operating rod 20 passes through the contact box and is securedly united to a bracket 56 which engages in a tunnel 58 in which the parts 17 making up the main contact bridge 16 are mounted. The main contact bridge return springs 38 bear on a bar 60 which is stationary in relation to the circuit breaker case. In order not to complicate the figure unnecessarily, the means of securing the bar to the case have not been represented.

The parts 35 of the arcing contact bridge 34 are disposed on either side of the operating rod, and positioned in relation to one another by means of covers 62 and a spacer 64, the return springs 40 taking their bearing on the backplate of the contact box.

The breaking chambers and contact sub-assembly are disposed inside an intermediate case 66. The bearing 52 is fixed to the outside, on the upper wall of the intermediate case, which also supports the opening and closing coils.

The circuit breaker case is formed by the assembly of the intermediate case 66, the bottom case 14 and a cover 68 disposed on the top of the circuit breaker. The latter naturally comprises a transparent part allowing the indicating part 50 to be observed from outside. As shown in the figures, all the parts of the breaking assembly of the circuit breaker, breaking chambers and contact sub-assembly, are located in the intermediate case, in the central part of the circuit breaker. The opening and closing control parts are located in the upper part of the case and protected by the cover 68, whereas the current terminals are located in the bottom part of the case. Practically total separation of the operating mechanism, the breaking parts and the electrical connection parts is thus achieved.

A current sensor 70 is housed in the bottom case around one of the current terminals.

A connector 72, mounted on the upper face of the intermediate case, is designed to provide the electrical connections between the opening and closing coils and a trip device, not shown, designed to control the circuit breaker. The connector 72 also transmits the information from the current sensors 70 and electrical signalling contacts.

The device according to the invention operates as follows:

In the closed position of the circuit breaker (FIG. 1), the main contact bridge 16 is biased by the springs 38 in the direction of the stationary main contacts, the arcing contact bridge 34 being biased by the springs 40 in the direction of the stationary arcing contacts 32. The current flows through the terminals 10, 12 and the main contact bridge 16. The current sensor 70 supplies the trip device, not shown, with a current measurement. The opening and closing coils 22 and 42 are not supplied and the opening and closing disks 26 and 44 are in the rest position in proximity to the corresponding coils.

When a fault current is detected or an opening order given, the trip device causes supply of the opening coil 22 and upward repulsion of the assembly formed by the opening disk 24 and the piston 26, drawing the operating rod 20 upwards. As the latter is securedly united to the bracket 56, itself securedly united to the tunnel 58 supporting the main contact bridge 16, the latter is drawn upwards, against the force of the return springs 38. The main circuit opens and the current is switched onto the arcing circuit. After a predetermined travel, the upper part of the tunnel 58 comes into contact with the bottom part of the parts 35 of the arcing contact bridge 36 and draws the latter upwards against the force of the return springs 40, also opening the arcing circuit.

Arcs are then formed in series in the arcing circuit, these arcs being extinguished quickly in the breaking chambers 36.

At the end of the operating rod opening travel, the latching ring 28 releases the half-moon 30 which pivots and locks the latching ring, and consequently the operating rod and the contacts, in the open position.

The opening disk 24 then returns to the rest position, as shown in FIG. 2, whereas the piston 26 securedly united to the operating rod remains in the up position.

Closing of the circuit breaker is controled by supply of the closing coil 42, which repels the closing disk upwards, bringing about unlocking of the latching ring by making the half-moon 30 pivot in the opposite direction by means of the bar 46 and the closing rod 48. The action of the return springs 38 and 40, returns the contact bridges, tunnel, bearing, operating rod, latching ring and piston to the closed position represented in FIG. 1.

A very small clearance separates the piston 26 laterally from the opening disk 24, allowing a controled air outlet. Thus, when closing of the circuit breaker takes place, the downward movement of the operating rod piston and the contacts is slowed down (dash-pot effect), thus preventing too great calking of the contacts.

The fast return of the opening disk 24 to the rest position, at the end of the opening travel, enables opening of the circuit breaker to be accomplished, in the event of a closing order being followed very quickly by a new opening order, before the piston 26 has returned to its final rest position. Indeed, to ensure repulsion of the disk, the clearance separating the latter from the coil must be as small as possible at the moment the coil is supplied. As the disk is repelled upwards, it will stop the downwards movement of the piston and the operating rod and will drive them in its upwards movement, thus interrupting closing of the circuit breaker and ensuring its re-opening.

In the case of a three-pole circuit breaker, each of the poles comprises an independent opening mechanism, with its own opening coil and its independent half-moon locking mechanism. Good safety is thus achieved, failure of one of the opening mechanisms not preventing the other two poles from opening.

Figure 3:
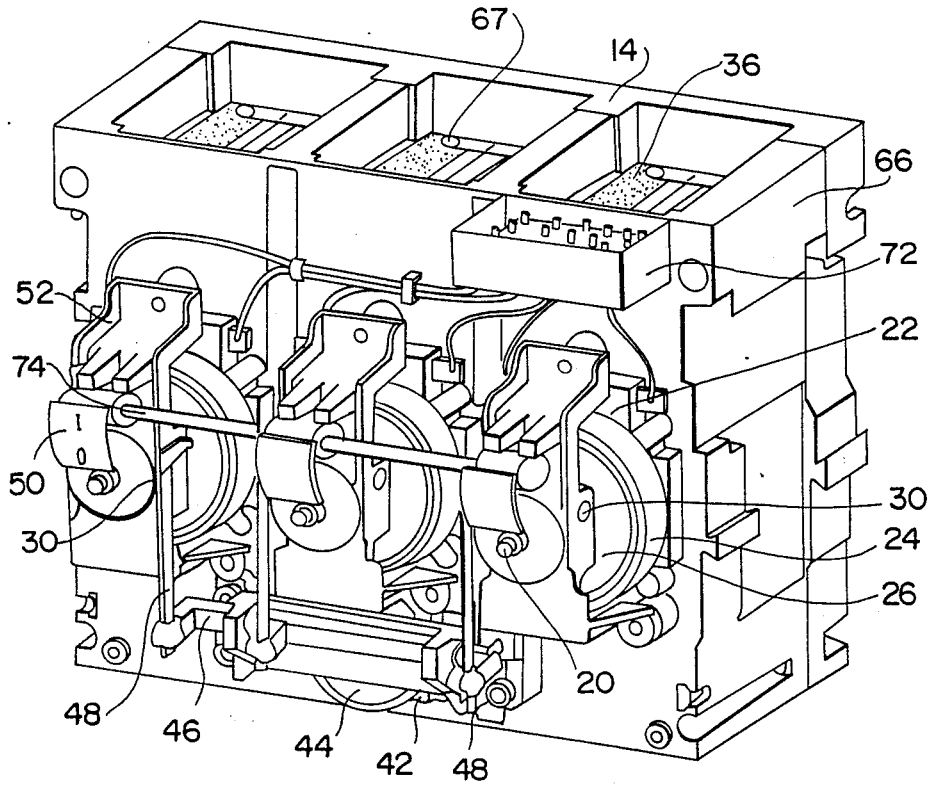
FIG. 3 represents a three-pole limiting circuit breaker according to the invention in perspective front view, after the cover has been removed.
Figure 4:
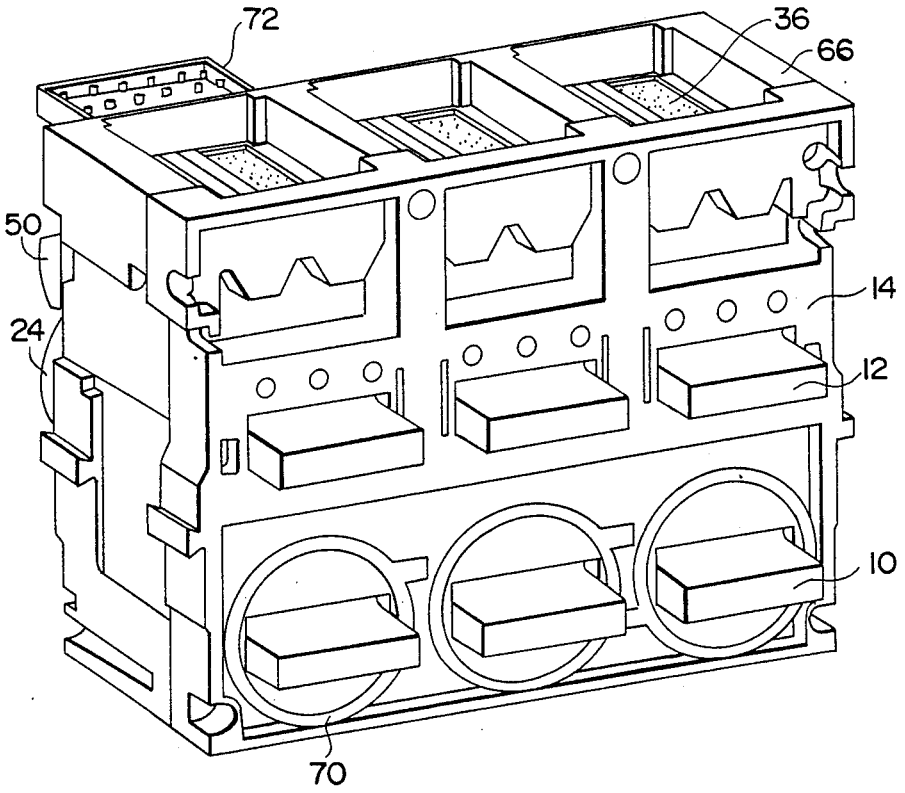
FIG. 4 represents a three-pole limiting circuit breaker according to the invention in perspective rear view, after the cover has been removed.

In the preferred embodiment represented in FIGS. 3 and 4, on the other hand, the three-pole circuit breaker comprises a single closing system, simultaneously controlling unlocking of the three poles. The single closing coil 42 is preferably disposed in the centre pole and controls, via the single closing disk 44, the closing bar common to the three poles, which actuates one closing rod 48 per pole, for simultaneous unlocking of the three half-moons 30. As the weight of the unlocking mechanism parts is small, it is thus possible to obtain a very fast response time to a circuit breaker closing order, by means of a single Thomson effect mechanism.

In FIG. 3, it can be seen that the indicating parts 50 of the three poles are preferably coupled by means of a bar 74, in such a way that opening of the circuit breaker can only be signalled when the three poles are open. Indeed, so long as one of the poles is closed, the corresponding operating rod 20 repels the associated end of the corresponding indicating part 50 downwards, preventing pivoting of the bar, and consequently, pivoting of the indicating parts of the other poles, even if the latter are in the open position.

The structure of the circuit breaker described above enables easy access to be had to the different parts of the circuit breaker. The operating mechanism parts are easily accessible by simply removing the cover 68. Removing the bottom case 14 supporting the stationary contact terminals gives access to the contact sub-assembly 18, which forms a removable sub-assembly which can be checked or exchanged if necessary. The breaking chambers 36 can be inspected or modified by sliding them in the intermediate case 66 having first removed the fixing screws 67.

We claim:

1. A limiting circuit breaker with high-speed contact opening control by Thomson effect, comprising, per pole, a movable assembly having a movable main contact bridge forming a main circuit with a pair of stationary main contacts connected to current terminals, a movable arcing contact bridge forming with a pair of stationary arcing contacts an arcing circuit connected in parallel to the main circuit, a movable assembly operating mechanism, for opening the main circuit and the arcing circuit, comprising a Thomson effect propelling part, a locking device of the movable assembly in the open position of the contacts and an unlocking control device, the main contact bridge being disposed between the stationary main contacts and the Thomson effect propelling part, the movable assembly comprising an operating rod securedly united to the main contact bridge, the Thomson effect propelling part comprising an annular opening coil surrounding said rod, an opening disk disposed facing the opening coil and movable in relation to said rod, and an annular piston securedly united to the operating rod, springs being disposed between the disk and the piston, in such a way that a current supply to the opening coil causes repulsion of the disk and of the piston and movement of the operating rod to the open position of the contacts, said springs returning the disk to the rest position facing the coil at the end of the opening travel.

2. The limiting circuit breaker according to claim 1, comprising two breaking chambers disposed on either side of the arcing circuit, the circuit breaker case being formed by assembly of an intermediate case containing the breaking chambers and a contact assembly comprising the movable contacts and their drive parts, a bottom case from the rear face of which the current terminals protrude out and supporting the stationary contacts, and a cover protecting the movable assembly control mechanism parts, disposed in the upper part of the case.

3. The limiting circuit breaker according to claim 1, wherein the locking device of the movable assembly in the open position of the contacts comprises a half-moon capable of pivoting after movement of an operating rod of the movable assembly, in such a way as to prevent movement of the latter in the opposite direction.

4. The limiting circuit breaker according to claim 3, wherein the unlocking control device is formed by a closing coil repelling a closing disk by Thomson effect making the half-moon pivot to the unblocked position of the operating rod, the contacts then being returned to the closed position by the action of return springs.

5. The limiting circuit breaker according to claim 1, comprising a contact sub-assembly comprising a contact box, made of molded plastic material, through which an operating rod passes securedly united to a tunnel made of molded plastic material, in which the main contact bridge is fixed, return springs taking their bearing on the backplate of the contact box and on the arcing contact bridge formed by parts disposed on either side of the operating rod, a bar designed to be fixed to the circuit breaker case being disposed inside the tunnel and acting as bearing point for return springs of the main contact bridge, in such a way that the movement of the operating rod when a circuit breaker opening order occurs first causes movement of the tunnel and of the main contact bridge against the force of the associated return springs, followed, when the tunnel comes into contact with the arcing contact bridge, by subsequent movement of the arcing contact bridge against the force of the associated return springs.

6. The limiting circuit breaker according to claim 1, wherein each pole comprises an independent opening control mechanism and an independent locking device of the movable assembly in the open position, the unlocking control device being common to all the poles of the limiting circuit breaker and comprising a single closing coil and a single closing disk connected to a closing bar actuating a plurality of closing rods associated with the different poles and bringing about unlocking of the corresponding pole.

7. The limiting circuit breaker according to claim 1, comprising an indicating part per pole, said part being moved to the closed position by the movable assembly operating device, and pivoting to the open position by the action of torsion springs, the indicating parts of the different poles being connected by a bar so as to only be able to pivot to the open position when all the poles are in the open position.

* * * * *